US007427205B2

(12) United States Patent
Sasaki et al.

(10) Patent No.: US 7,427,205 B2
(45) Date of Patent: Sep. 23, 2008

(54) LEVER TYPE CONNECTOR

(75) Inventors: Yasuhiro Sasaki, Shizuoka-ken (JP); Shoji Yamamoto, Shizuoka-ken (JP); Takahiro Yoneda, Atsugi (JP); Ryo Sawada, Atsugi (JP); Ken Yoshimura, Atsugi (JP)

(73) Assignees: Yazaki Corporation, Tokyo (JP); Nissan Motor Co., Ltd., Kanagawa-ken (JP)

( * ) Notice: Subject to any disclaimer, the term of this patent is extended or adjusted under 35 U.S.C. 154(b) by 0 days.

(21) Appl. No.: 11/701,376

(22) Filed: Feb. 2, 2007

(65) Prior Publication Data

US 2007/0202722 A1 Aug. 30, 2007

(30) Foreign Application Priority Data

Feb. 2, 2006 (JP) ..... 2006-025918

(51) Int. Cl.
*H01R 13/62* (2006.01)

(52) U.S. Cl. ..... 439/157; 439/372

(58) Field of Classification Search ..... 439/157, 439/160, 372

See application file for complete search history.

(56) References Cited

U.S. PATENT DOCUMENTS 5,474,461 A * 12/1995 Saito et al. ..... 439/157
5,586,894 A * 12/1996 Taniuchi et al. ..... 439/157
5,616,038 A * 4/1997 Okamoto et al. ..... 439/157
5,810,612 A * 9/1998 Flask et al. ..... 439/157
6,422,881 B1 * 7/2002 Puhl et al. ..... 439/140
6,471,527 B2 * 10/2002 Fukamachi et al. ..... 439/157
6,565,372 B2 * 5/2003 Bakker et al. ..... 439/157
6,793,522 B2 * 9/2004 Yamashita ..... 439/489
7,201,591 B2 * 4/2007 Fujii ..... 439/157
2003/0054681 A1 * 3/2003 Hatagishi et al. ..... 439/157

FOREIGN PATENT DOCUMENTS

JP 2002-025696 1/2002

* cited by examiner

*Primary Examiner*—Tulsidas C. Patel
*Assistant Examiner*—Vladimir Imas
(74) *Attorney, Agent, or Firm*—Finnegan, Henderson, Farabow, Garrett & Dunner, L.L.P.

(57) ABSTRACT

A lever type connector is provided with a lever assisting in fitting or detaching first and second connector housings thereof. A lever is fitted to the first connector housing. A plurality of projecting parts is provided in a circumference of the lever. A plurality of receiving parts is provided in the first connector housing to slidably engage with the projecting part. Engagement between the projecting and receiving parts prevents the lever from deformation and warpage in a rotating operation of the lever for the connecting operation. The projecting parts and the receiving parts are configured so that the projecting parts and the receiving parts are engaged only when the lever is positioned so that the fitting force is large in the rotating operation, and the projecting parts and the receiving parts are not engaged when the lever is positioned in another state in which the fitting force is small.

4 Claims, 10 Drawing Sheets

LEVER TYPE CONNECTOR

CROSS REFERENCE TO RELATED APPLICATION

This application claims benefit of priority under 35 USC 119 based on Japanese Patent Application P2006-025918 filed Feb. 2, 2006, the entire contents of which are incorporated by reference herein.

BACKGROUND OF THE INVENTION

1. Field of the Invention

The present invention relates to a lever type connector capable of fitting or detaching one connector housing into or out of another connector housing, using a small force by a rotating operation of a lever.

2. Description of the Related Art

In connectors like a multi-pin connector requiring large fitting or attachment force, a lever type connector provided with a lever is conventionally used so that the lever assists the attachment force. The lever type connector comprises a first connector housing (e.g. male connector housing); a lever rotatably provided in the first connector housing, the lever having a cam groove thereon; and a second connector (e.g. female connector housing) provided with a projection portion being fitted to the cam groove. In a first step of fitting the first and second connector housing to each other, the lever is positioned to face the projection portion at an entrance of the cam groove. In the next step, the lever is rotated to guide the projection portion into the cam groove, and finally both the first and second connector housings are completely connected to each other. In this case, leverage by the lever is utilized to reduce the force required for connecting the connector housings.

FIG. 1 and 2 are schematic diagrams showing a conventional lever type connector disclosed in Japanese Patent Laid-Open Publication 2002-025696. FIG. 1 is a plan view explaining a state of the conventional connector in which a projection portion slightly enters into a cam groove of a lever. FIG. 2 is a plan view of a final state of the conventional connector when the lever is completely rotated to fit a first connector housing to a second connector housing.

As shown in these figures, this type of lever connector comprises a pair of a first connector housing 110 and a second connector housing 150 being fitted to the first connector housing 110. The housings accommodate terminals (not shown) in terminal cavities provided therein. The first connector housing 110 has a lever 130 formed with a square U-shaped cross section. The lever 130 has a hole 132 in a base portion thereof a cam groove 140 thereon and a handle 149 in an end thereof.

The cam groove 140 is provided around the hole 132 within a predetermined angle range with respect to the hole 132. The cam groove 140 is formed from a curvilinear groove entrance 141 so that an end of the cam groove 140 approaches closer to the hole 132. A supporting shaft 111 is provided on an outer wall of the first connector housing 110, and the shaft 111 is rotatably engaged with the hole 132 of the lever 130, whereby the lever 130 can rotate around the supporting shaft 111 within the predetermined angle range.

On the other hand, the second connector housing 150 has a pin 155 projecting from an outer wall thereof, and the pin 155 is provided so as to slidably engage in the cam groove 140. In a state when the first and second connector housings 110, 150 are provisionally fitted to each other, the pin 155 faces to the groove entrance 141 of the cam groove of the lever 130. FIG. 1 shows a state when the pin 155 has slightly entered into the groove 140 from the groove entrance 141.

Two guiding walls 112, 113 are provided on the outer wall of the first connector housing 110. The guiding walls slidably contact the circumference of the base portion of the lever 130 and have eaves 114, 115 on a side facing toward the supporting shaft 111. The base portion is circularly formed around the hole 132. Four grooves 124A, 125A, 124B, 125B are further formed on the circumference of the base portion. Two of the four grooves 124A, 125A engage with the eaves 114, 115 to maintain an initial position of the lever 130 to enable the second connector housing 150 to fit or attach to the first connector housing 110. The other two grooves 124B, 125B engage with the eaves 114, 115 to maintain a final position of the lever 130 in which the fitting is completed. As described above, the second connector housing 150 can be fitted to or detached from the first connector housing 110 by positioning the grooves 124A and 125A; 124B and 125B respectively to the eaves 114, 115 by rotation of the lever 130.

When the first connector housing 110 and the second connector housing 150 are provisionally fitted to each other by positioning the lever 130 in the initial position, the pin 155 faces to the groove entrance 141 of the groove 140. Next, when the lever 130 is rotated toward the final position, the pin 155 enters into the cam groove 140 both by leverage of the lever 130 and by cam action of the cam groove 140. Finally, the first connector housing 110 and the second connector housing 150 are completely fitted to each other when the lever reaches the final position.

During this rotating operation of the lever 130, the circumference of the base portion of the lever 130 is guided by the guiding walls 112, 113 and is slidably supported by the eaves 114, 115. Accordingly, wobble of the lever 130 can be avoided. When the lever 130 is completely rotated to the final position as shown in FIG. 2, the first connector housing 110, the second connector housing 150 and the terminals thereof are correctly connected to each other.

When detaching the second connector housing 150 from the first connector housing 110, the lever 130 is backwardly rotated to the initial position. The leverage of the lever 30 and the cam action of the cam groove 140 pushes out the second connector housing from the first connector housing by guiding the pin 155 in the cam groove to the groove entrance 141. The housings are finally detached from each other when the lever 30 is completely rotated to the initial position.

In the above lever type connector, the rotating operation of the lever 130 creates the fitting or fitting force, however, the lever 130 is subjected to stress during the operation. If this stress is considerably large, the lever could unexpectedly deform or warp. Further, in the worst case, the lever could detach from the supporting shaft 111. The eaves 114, 115 and the guiding walls 112, 113 are provided to avoid these problems. However, The eaves and guiding walls have always to contact with the circumference of the base portion of the lever 130, thus rotation resistance of the lever 130 is so large that the rotating operation of the lever 130 could be difficult. The grooves 124A, 125A and the eaves 114, 115 restrict direction of the lever 130 when the lever is installed, however, the lever 130 is prone to be instead incorrectly.

SUMMARY OF THE INVENTION

In light of the above-described problems, an objective of the present invention is to provide a lever type connector which prevents a lever of the connector from deforming and warping during attachment of the housings, which makes installation of the lever easy and which reduces rotation resistance of the lever during a rotating operation thereof.

An aspect of the present invention is to provide a lever type connector comprising a first connector housing having a supporting shaft, a lever rotatably supported by the supporting shaft, having a curvilinear cam groove formed thereon so that an end of the cam groove approaches closer to a rotation center of the lever, a plurality of projecting parts provided in a circumference of the lever, a plurality of receiving parts provided in the first connector housing, the receiving parts slidably engaging with the projecting part of the lever, and a second connector housing to be fitted to the first connector housing, having a pin engaged with the cam groove; wherein a rotating operation of the lever in a state where the cam groove slidably engages with the pin assists fitting and detaching forces between the first and second connector housings, wherein the projecting parts and the receiving parts are configured so that the projecting parts and the receiving parts are engaged only when the lever is positioned in a state where the fitting force is large in the rotating operation of the lever, and the projecting parts and the receiving parts are not engaged when the lever is positioned in another state in which the fitting force is small in the rotating operation of the lever.

According to the above construction, rotation resistance of the lever can be reduced and the operability of the lever can be improved. In the rotating operation of the lever, there is a large attachment force when the lever is in a region where the first connector housing starts to connect to the second connector housing and terminals thereof are being connected to each other. There is a small attachment force when the lever is in another region. Since stress in the lever can be also reduced, such arrangement prevents the lever from deforming and warping in the rotating operation of the lever, and the connection can be firmly accomplished. Further, since the lever can be installed to the first connector housing only when the lever is directed so that the projecting parts do not overlap the receiving parts, the attachment become easy and avoids misattachment of the housings.

In addition to the foregoing construction, one of the projecting part and the receiving part may be provided with double walls arranged normal to a rotating direction of the lever. The double walls may slidably engage with the other of the projecting part and the receiving part therebetween.

According to the above construction, the engagement by the double walls regulates wobble of the lever, thus deformation or warpage of the lever can be avoided effectively in the rotating operation of the lever.

In addition to the foregoing construction, the projecting part and the receiving part, respectively may have a rib, and each rib slidably contacts each other to allow the lever to rotate.

According to the above construction, the ribs can secure engagement between the projecting part and the receiving part, and deformation or warpage of the lever can be avoided effectively in the rotating operation of the lever.

In addition to the foregoing construction, the supporting shaft may have a claw portion in a tip end thereof.

According to the above construction, the claw portion can prevent the lever from separating from the supporting shaft. Further, since the lever is stably supported both by the claw portion and by the engagement between the projecting part and the receiving part, friction and stress caused by the rotating operation of the lever can be reduced, thus deformation or warpage of the lever can be avoided effectively.

DETAILED DESCRIPTION OF THE INVENTION

Figure 1:
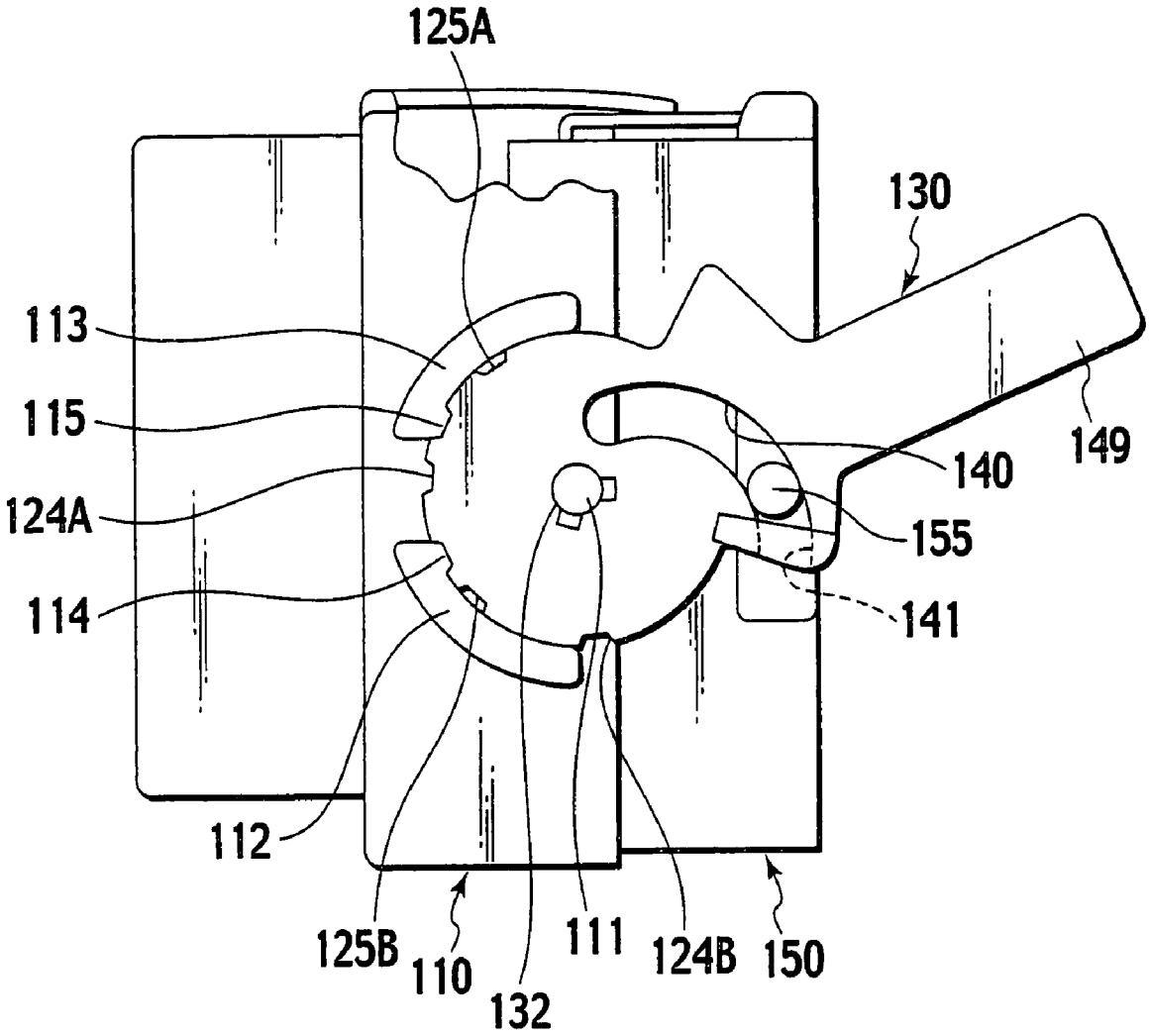
FIG. 1 PRIOR ART
FIG. 1 is a schematic block diagram of a conventional lever type connector, showing an initial fitting state in which a pin is entering into a cam groove.
Figure 2:
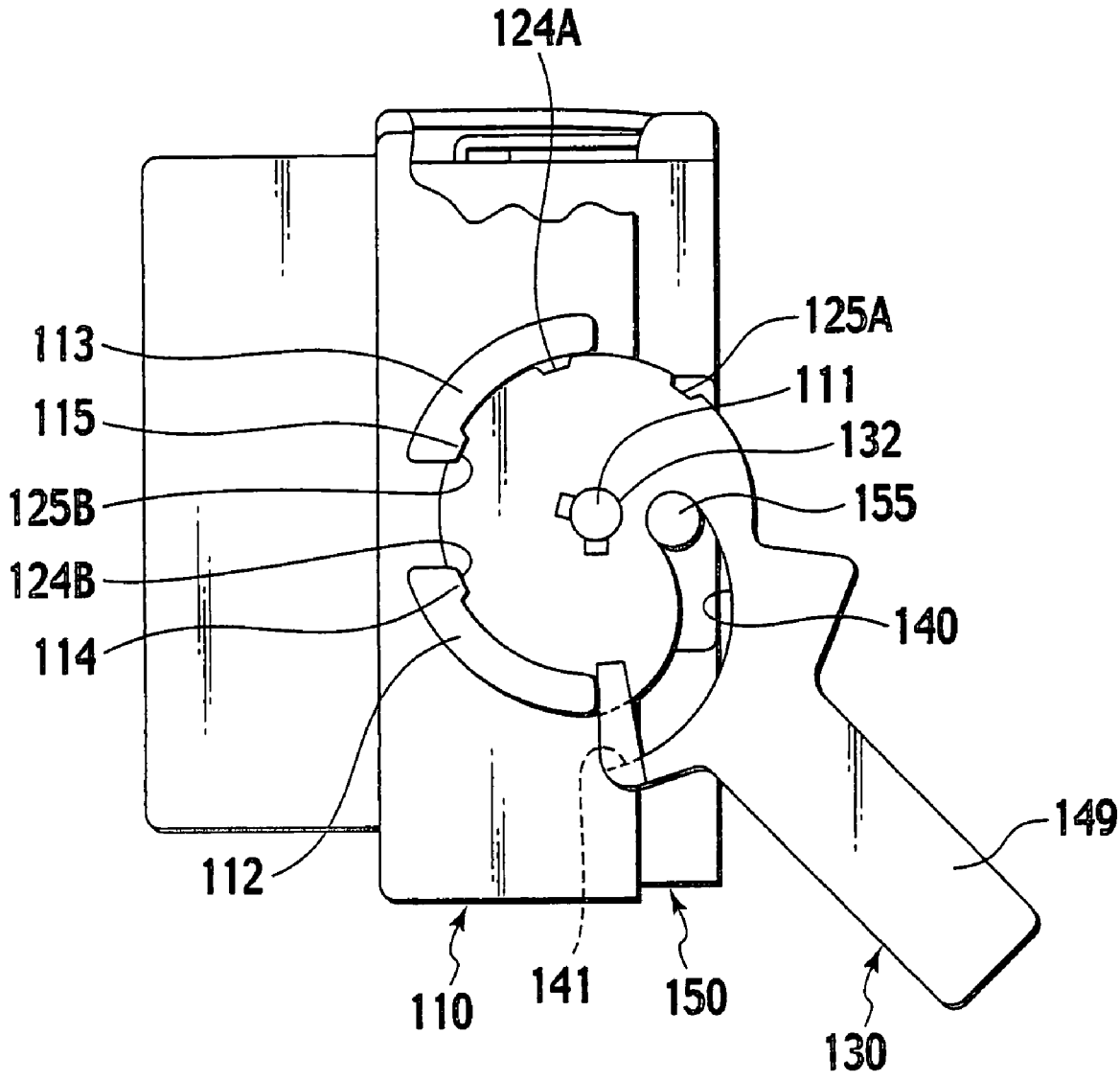
FIG. 2 PRIOR ART
FIG. 2 is a plan view of the connector showing a final fitting state in which a lever is rotated to a final position from the initial state of FIG. 1.

An embodiment of the present invention will be explained below with reference to the drawings.

The lever type connector includes a first connector housing and a second connector housing configured to be connected to the first connector housing. FIGS. 1 to 4 show only a configuration of the first connector housing 10 and a lever 30 to clarify the present invention. The first connector housing has a terminal cavity (not shown) and a terminal (not shown) accommodated in the terminal cavity.

The lever 30, formed with a square U-shaped cross section, is fitted on an outer wall of the first connector housing 10. A hole 32 and a cam groove 40 are provided in a base portion of the lever 30. Further, a handle 49 is provided at an end of the lever 49.

The cam groove 40 is formed around the hole 32 in a predetermined angle range with respect to the hole 32. From a groove entrance 41 to an end of the cam groove, the cam groove 40 is curvilinearly formed so that the end of the cam groove 40 approaches closer to the hole 32. A supporting shaft 12 is arranged on the outer wall of the first connector housing 10, the supporting shaft is rotatably engaged with the hole 32 of the lever 30. The lever 30 rotates around the hole 32 within the predetermined angle range.

On a circumference of the lever 30, three projecting parts 35, 36, 37 are provided at regular intervals. The circumference between the projections is formed as an opening 38, 39 having a shape corresponding to a plan-viewed receiving part (described later).

The second connector is provided with a pin, as an example shown in FIG. 1, to engage with the cam groove 40. In an initial state where the second connector housing is provisionally connected to the first connector housing 10, the pin is positioned in the vicinity of the groove entrance 41.

Two receiving parts 14 are provided with the first connector housing 10 and are formed with an arc shape so as to slidably engage with the circumference of the base portion of the lever 30. The receiving parts 14 have a groove 14*a* so that the projecting parts 35, 36, 37 are slidably engaged with the groove to prevent the lever 30 from deforming and warping in the rotating operation of the lever 30. One of the receiving parts 14 has a guiding wall 16 to guide the lever 30.

The projecting parts 35, 36, 37 and the receiving parts 14 are arranged in a manner so as to be engaged only when the lever is positioned in a state in which the fitting force is large in the rotating operation of the lever, and in which the projecting parts and the receiving parts are not engaged when the lever is positioned in another state in which the fitting force is small in the rotating operation of the lever, and the lever is installed to the first connector housing.

Figure 6:
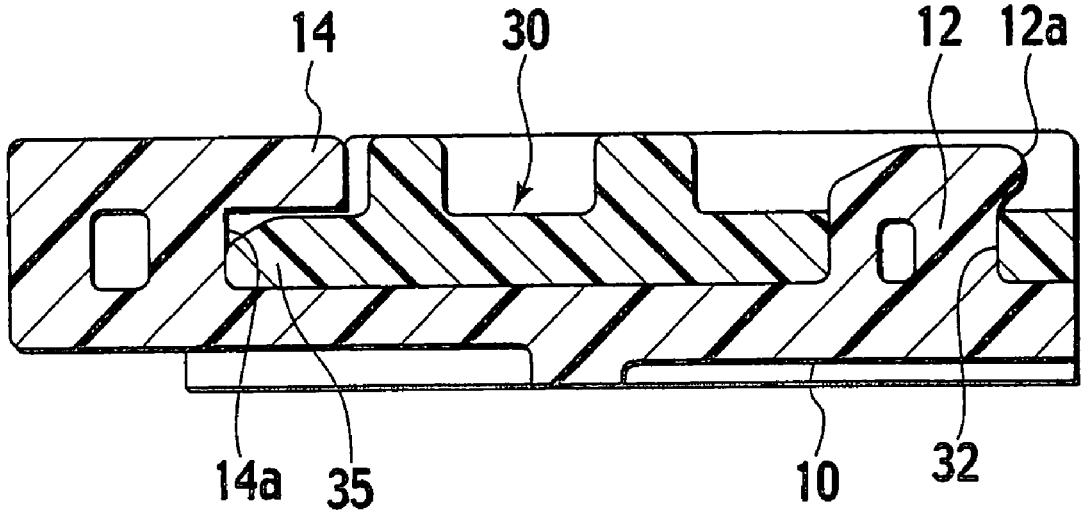
FIG. 6 is a cross-sectional view taken from line VI-VI of FIG. 5.

As shown in FIG. 6, a claw portion 12*a* is formed in a tip end of the supporting shaft 12 engaged with the hole 32 of the lever 30. The claw portion can prevent the lever 30 from detaching from the supporting shaft 12.

An operation of the lever type connector will be explained next.

Figure 3:
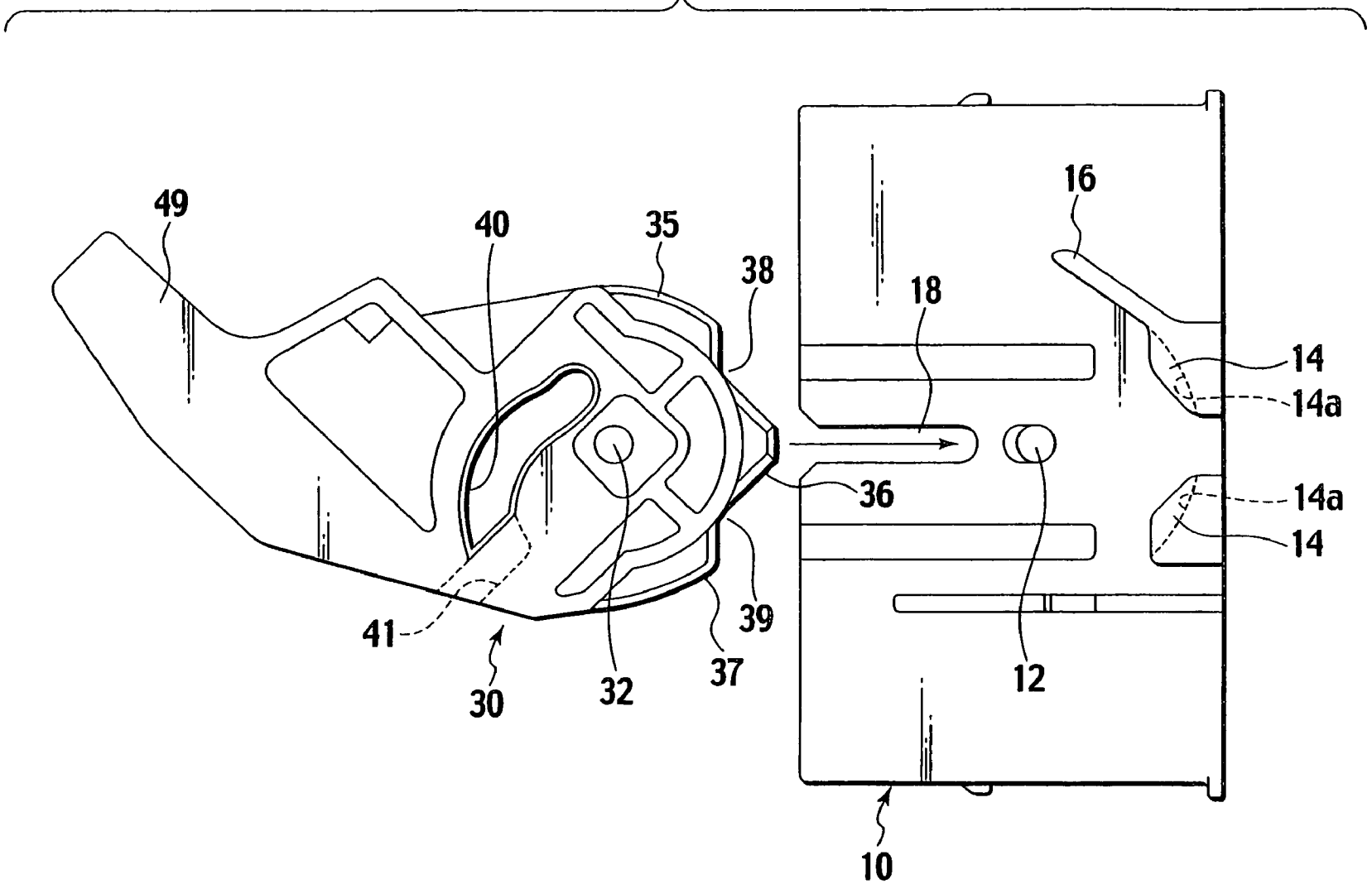
FIG. 3 is an exploded plan view of a lever type connector according to a first embodiment of the present invention.
Figure 4:
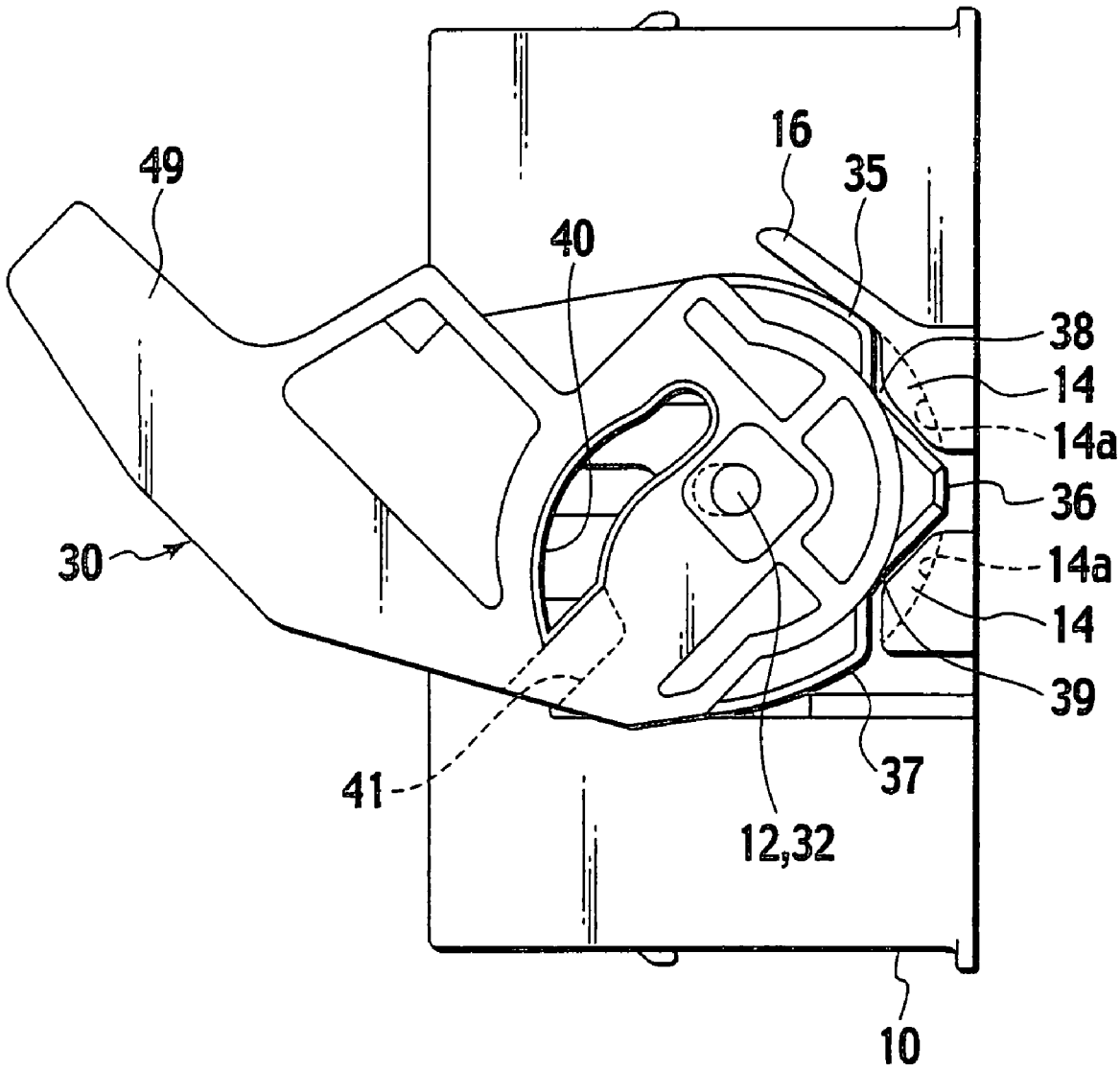
FIG. 4 is a plan view showing a lever installed to a first connector housing.

When the lever 30 is installed to the first connector housing 10, the elements are positioned as shown in FIG. 3. In this case, the projecting parts 35, 36, 37 of the lever 30 do not interfere with the receiving parts 14 so that the lever 30 can be fitted to the first connector housing 10 by engaging the hole 32 with the supporting shaft 12 through the claw portion 12*a*. As described above, shapes of the projecting parts 35, 36, 37 and the receiving parts define a single direction of the lever 30 which can be installed to the first connector housing 10. In other words, the arrangement of the projecting parts and the receiving parts prevents mis-attachment of the lever 30.

Figure 5:
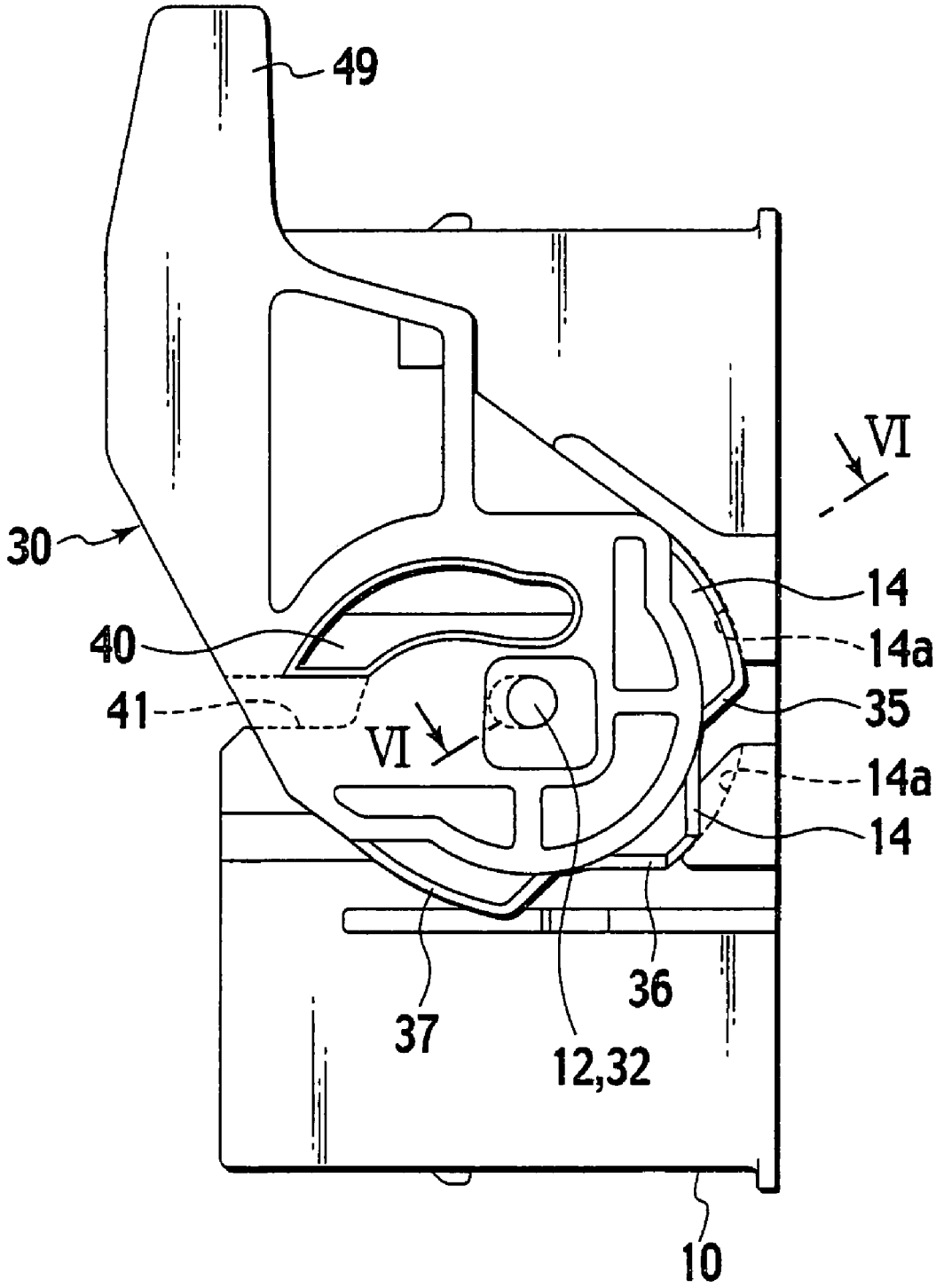
FIG. 5 is a plan view showing the lever rotated to an initial position.

After the lever 30 is installed, the lever 30 is rotated to an initial position as shown in FIG. 5, and the first connector housing 10 is provisionally engaged with the second connector housing. In this case, the pin of the second connector housing faces to the groove entrance 41 of the cam groove 40. Next, the lever 30 is rotated by a handle 49 toward a final position. The pin is guided into the cam groove 40. Finally, the first connector housing 10 and the second connector housing are completely fitted to each other when the lever 30 reaches the final position.

In the rotating operation of the lever 30, the attachment force is large when the lever 30 is positioned in a state where the first connector housing starts to be connected to the second connector housing and terminals therein are being connected The attachment force is small when the lever 30 is positioned in another state. The projecting parts and the receiving parts are engaged only when the attachment force is large. Accordingly, the resistance to rotation of the lever 30 can be reduced as much as possible, and the operability of the lever can be improved. Deformation or warpage of the lever 30 can also be avoided, and the first and second connector housing can be firmly fitted to each other.

According to the above embodiment, the lever 30 is stably supported both by the claw portion 12*a* and by engagement between the projecting parts 35, 36, 37 and the receiving parts 14. This support can farther reduce the resistance to rotation of the lever 30, thus deformation or warpage of the lever 30 can be stably regulated.

When the lever 30 is backwardly rotated to the initial position, the pin in the cam groove 40 is guided toward the groove entrance 41. The second connector housing is finally detached from the first connector housing 10, when the lever 30 is positioned in the initial position.

Figure 7:
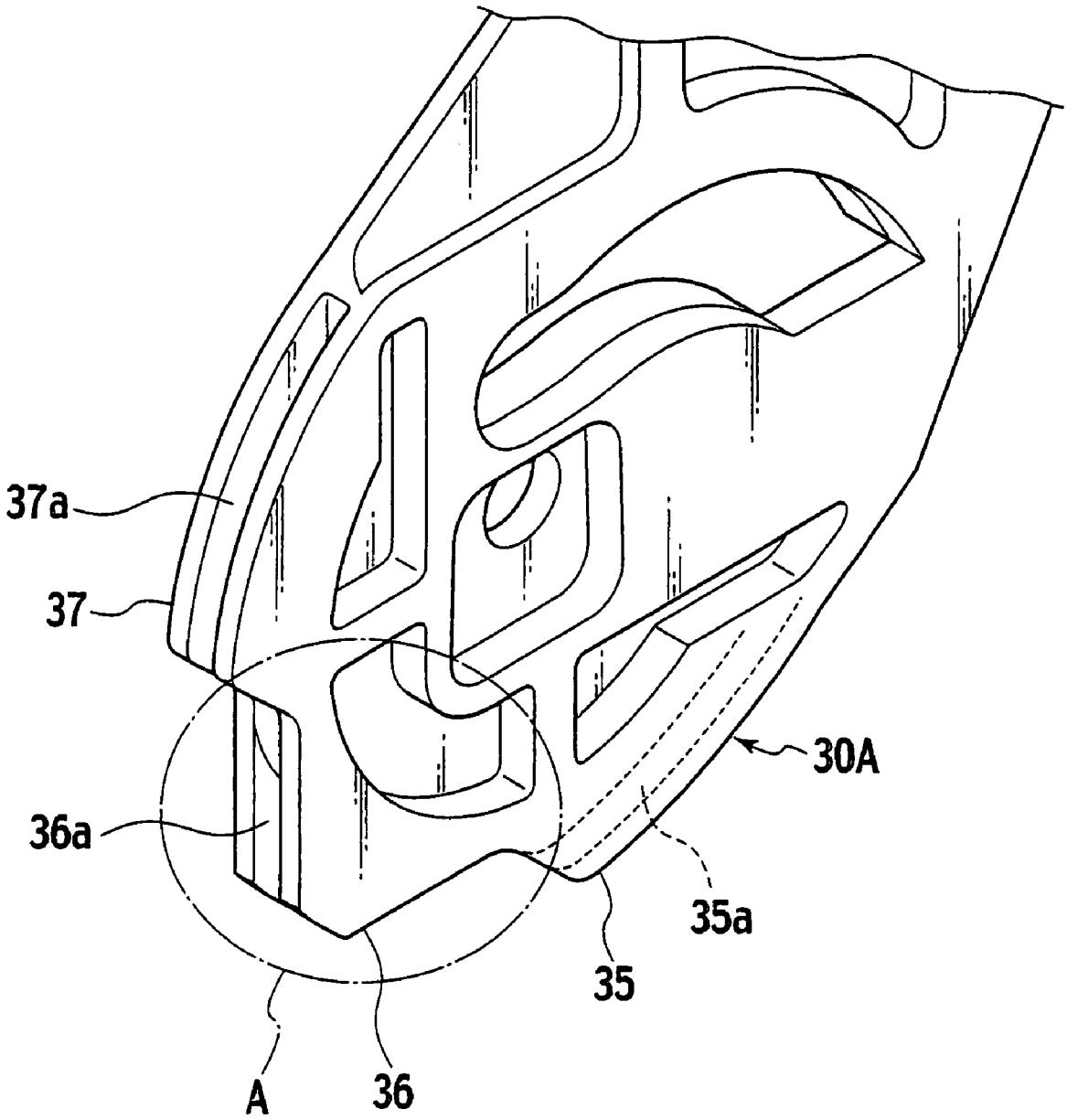
FIG. 7 is a perspective view of a lever according to a second embodiment of the present invention.
Figure 8:
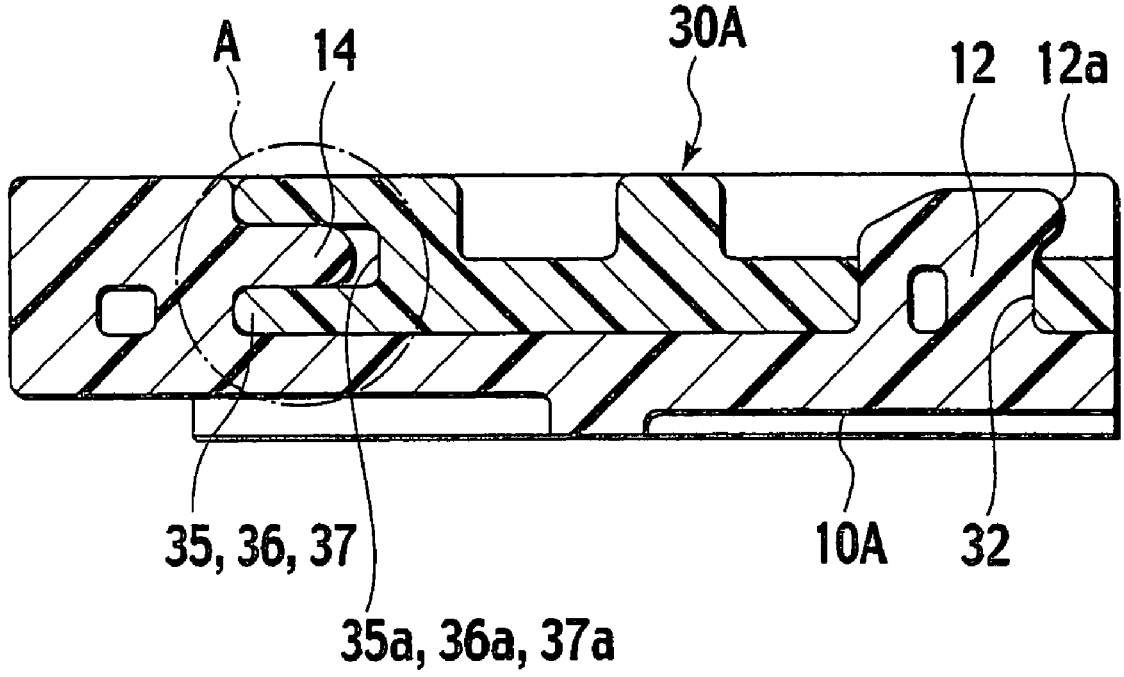
FIG. 8 is a cross-sectional view showing a state in which the lever and a first connector housing are engaged.

FIGS. 7 and 8 show a second embodiment. A part depicted by a surrounding chain line A is modified from the first embodiment. In this case, the projecting parts 35, 36, 37 are provided with double walls, and each wall is arranged in a regular interval normal to a rotating direction of a lever 30A. The receiving part is slidably engaged with clearances 35*a*, 36*a*, 37*a* between the walls. As another case, inversely, such double wall structure may be provided in the receiving part 14 so as to slidably engage with the projecting parts 35, 36, 37.

According to the second embodiment, the double wall structure can effectively prevent the lever 30A from deforming or warping in a rotating operation of the lever 30A.

Figure 9:
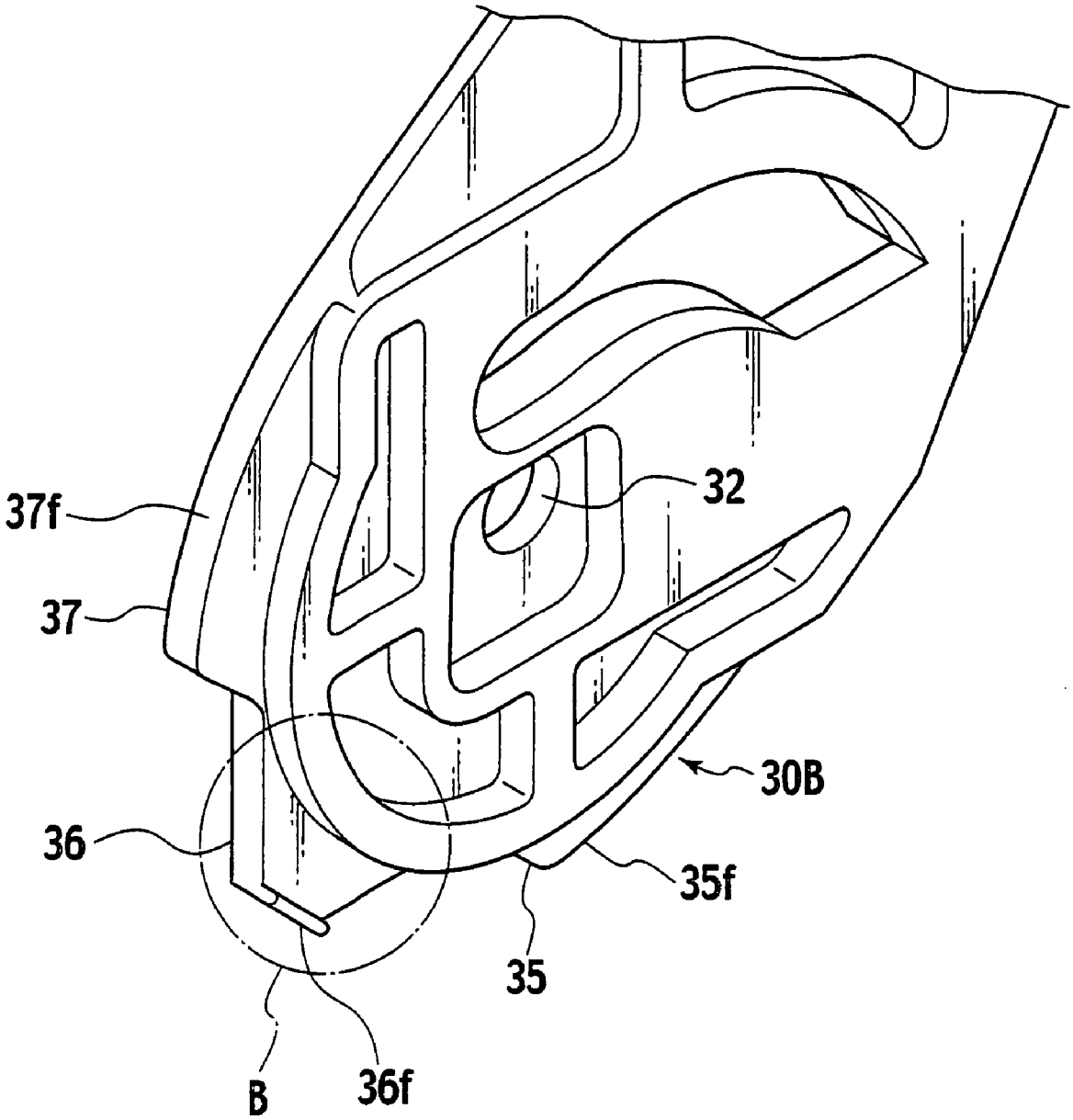
FIG. 9 is a perspective view showing a lever according to a third embodiment of the present invention.
Figure 10:
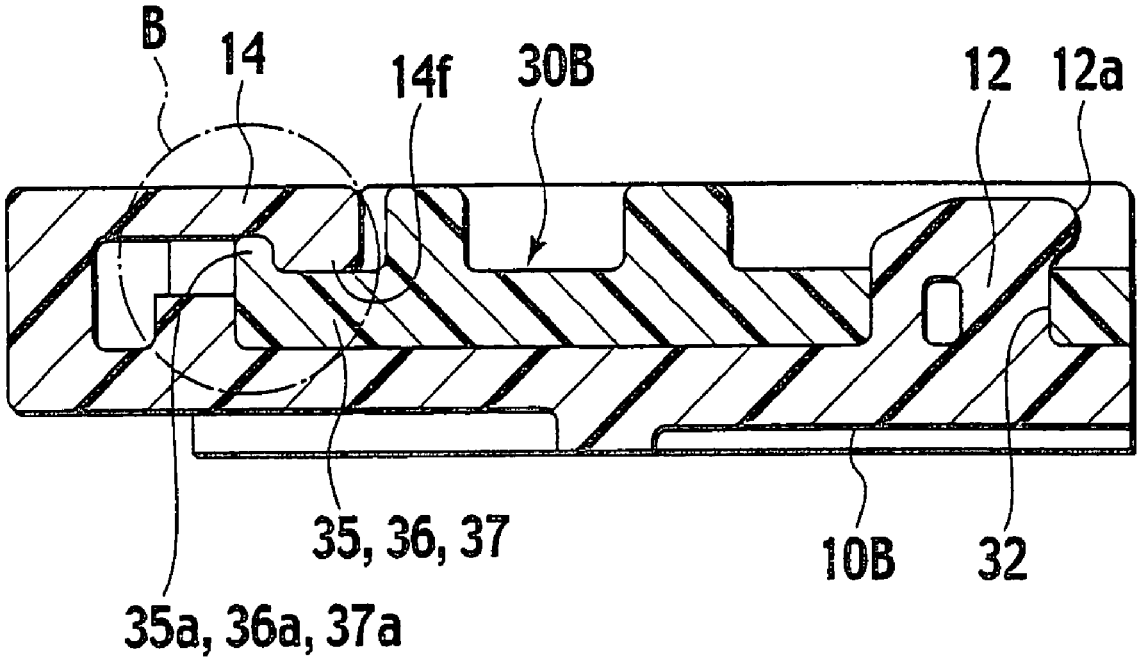
FIG. 10 is a cross-sectional view showing a state in which the lever and a first connector housing are engaged.

FIGS. 9 and 10 show a third embodiment. A part depicted by a surrounding chain line B is modified from the first embodiment. In this case, a rib 36*f* is provided on the projecting parts 35, 36, 37, and another rib 14*f* is provided on the receiving parts 14 so as to slidably contact the rib 36*f*.

These ribs promote engagement between the projecting parts 35, 36, 37 and the receiving parts 14. Thus, the ribs can more effectively prevent the lever 30B from deforming or warping in a rotating operation of the lever 30B.

What is claimed is:

1. A lever type connector, comprising:

a first connector housing having a supporting shaft;

a lever rotatably supported by the supporting shaft, the lever having a curvilinear cam groove with an end portion close to a rotation center of the lever;

a plurality of projecting parts provided at regular intervals in a circumference of the lever;

a plurality of receiving parts provided in the first connector housing, the receiving parts slidably engaging with the projecting parts of the lever; and a second connector housing fitted to the first connector housing, the second connector housing having a pin engaged with the cam groove;

wherein a rotating operation of the lever in a state where the cam groove slidably engages with the pin assists fitting and detaching forces between the first and second connector housings, wherein an arrangement of the regularly-spaced projecting parts and the receiving parts prevents mis-attachment of the lever, and wherein the projecting parts and the receiving parts are engaged when the lever is positioned in a first state in which the fitting force is large in the rotating operation of the lever, and the projecting parts and the receiving parts are not engaged when the lever is positioned in a second state in which the fitting force is small in the rotating operation of the lever.

2. The lever type connector according to claim 1, wherein one of the projecting part and the receiving part is provided with double walls arranged normal to a rotating direction of the lever, the double walls slidably engaged with the other of the projecting part and the receiving part therebetween.

3. The lever type connector according to claim 1, wherein the projection part and the receiving part, respectively, have a rib, and each rib is slidably contacted with each other to assist engagement between the projecting part and the receiving part while allowing the lever to rotate.

4. The lever type connector according to claim 1, wherein the supporting shaft has a claw portion in a tip end thereof to prevent the lever from being detached.

* * * * *